United States Patent [19]

Soeda et al.

[11] 4,142,472

[45] Mar. 6, 1979

[54] CONTROL APPARATUS FOR AN ELECTRICALLY DRIVEN SEWING MACHINE WITH STITCH PATTERN PRODUCING DEVICE

[75] Inventors: Katsuji Soeda; Fumio Sakuma; Mitsuhiro Ooyama, all of Sukagawa, Japan

[73] Assignee: Yamamoto Electric Industrial Co., Ltd., Fukushima, Japan

[21] Appl. No.: 825,479

[22] Filed: Aug. 17, 1977

[30] Foreign Application Priority Data

Oct. 12, 1976 [JP] Japan ..... 51-122060

[51] Int. Cl.[2] ..... D05B 3/02

[52] U.S. Cl. ..... 112/158 E; 318/568

[58] Field of Search ..... 112/158 E, 121.11, 121.12, 112/275, 277; 318/568

[56] References Cited

U.S. PATENT DOCUMENTS

| | | | |
|---|---|---|---|
| 3,734,038 | 5/1973 | Taketomi | 112/121.15 |
| 3,830,175 | 8/1974 | Levor | 112/121.12 |
| 4,074,642 | 2/1978 | Herr | 112/158 E |

*Primary Examiner*—Peter Nerbun

*Attorney, Agent, or Firm*—Armstrong, Nikaido, Marmelstein & Kubovcik

[57] ABSTRACT

A control apparatus for an electrically driven sewing machine with stitch pattern producing means comprises an electric signal generator for generating an electric signal related to at least one predetermined angular position of a main shaft of the sewing machine, set board means capable of setting therein a desired stitch pattern by means of a probe, and pattern detecting means for reading out cloth feed operation information and needle position information of the stitch pattern set at the set board means. The needle bar is set at a predetermined position in dependence upon the needle position information as read out, while cloth feed is effected in dependence upon the cloth feed operation information, whereby sewing operation is performed in the same stitch pattern as the one stored in the set board means.

5 Claims, 11 Drawing Figures

FROM SECOND COUNTER 30
FROM SET BOARD 6
FROM COUNTER 30
FROM SET BOARD 6
C6
C7
C8
C9
C10
C11
NR'a
NR'b
NR'c
NR'd
NR'e
NR'f
NT'a
NT'b
NT'c
NT'd
NT'e
NT'f
126
127
128
129
130
131
120

Vcc3
t3
10
11
FROM FIRST COINCIDENCE CIRCUIT GROUP 8
FROM SECOND COINCIDENCE CIRCUIT GROUP 9
L21
L22
L23
L24
L25
L26
L27
L28
L29
L30
L31
Tra
Trb
Trc
Trd
Tre
T'ra
T'rb
T'rc
T'rd
T're
T'rf
D21
D22
D23
D24
D25
D26
D27
D28
D29
D30
D31
D32
D33
D34
D35
D36
D37
D38
D39
D40
D41
D42
Sa
Sb
Sc
Sd
Se
Sf

Sa
Sb
Sc
Sd
Se
51
52
53
54
55
56
57
58
59
60
61
62
63
64
65
66

FIG. 9A
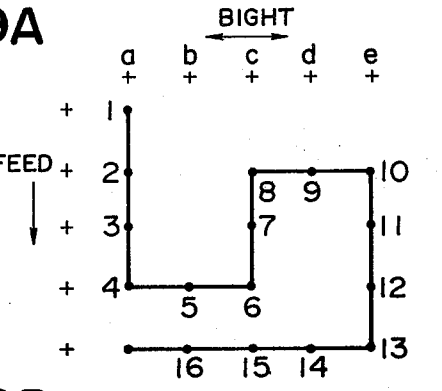
FIG. 9B
| STITCH NO. | BIGHT POSITION | BIGHT COORDINATE | FEED QUANTITY | FEED COORDINATE |
|---|---|---|---|---|
| 1 | a | a | ZERO | a |
| 2 | a | a | SMALL FORWARDING | b |
| 3 | a | a | SMALL FORWARDING | c |
| 4 | a | a | SMALL FORWARDING | d |
| 5 | b | b | ZERO | e |
| 6 | c | c | ZERO | f |
| 7 | c | c | SMALL FORWARDING | g |
| 8 | c | d | SMALL FORWARDING | h |
| 9 | e | d | ZERO | i |
| 10 | e | e | ZERO | j |
| 11 | e | e | SMALL FORWARDING | k |
| 12 | e | e | SMALL FORWARDING | l |
| 13 | e | e | SMALL FORWARDING | m |
| 14 | d | d | ZERO | n |
| 15 | c | c | ZERO | o |
| 16 | b | b | ZERO | p |
FIG. 9C
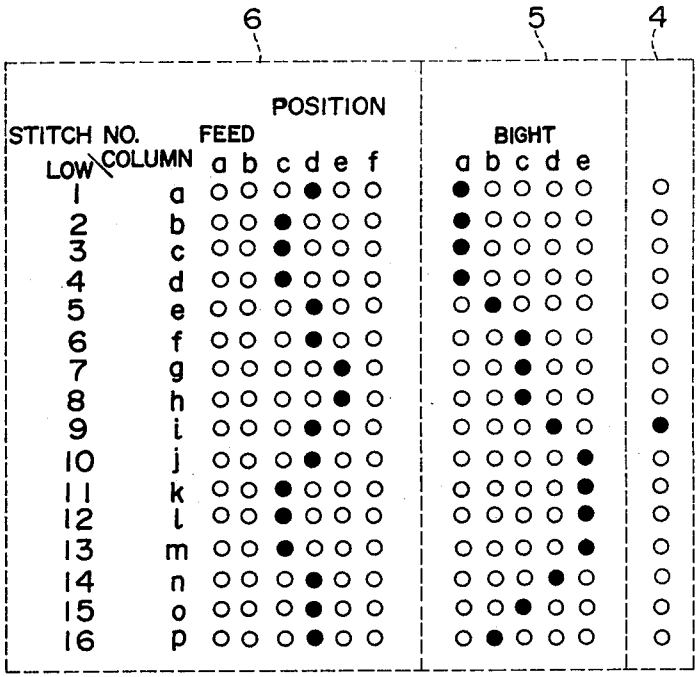

CONTROL APPARATUS FOR AN ELECTRICALLY DRIVEN SEWING MACHINE WITH STITCH PATTERN PRODUCING DEVICE

BACKGROUND OF THE INVENTION

The present invention relates to a control apparatus for an electrically driven sewing machine with a stitch pattern producing device, and in particular to a control apparatus for the electrically driven sewing machine which allows a sewing operation to be effected with a desired pattern stitch.

There has been hitherto known a control apparatus for an electrically driven sewing machine which is composed of information storage means such as ROM or the like for storing predetermined stitch patterns, an electric signal generator device for generating electric signals related to rotational angular positions of a main shaft of the sewing machine, means for reading out the stitch pattern information from the information storage means in response to the generated electric signals, and a driver device for controlling the needle position and the cloth feed operation in dependence upon the stitch pattern information as read out, thereby to carry out the pattern stitches in dependence upon the stitch pattern information. For example, this type control apparatus for the electrically driven sewing machine is disclosed in U.S. Pat. application Ser. No. 376,780 entitled "Sewing machines stitch pattern generation from stitch data stored in static memory", filed July 5, 1973 by John W. Wurst and issued Dec. 24, 1974 as U.S. Pat. No. 3,855,956 and assigned to The Singer Company.

However, the hitherto known electrically driven sewing machine of the above described type has suffered from many drawbacks. For example, in order to permit sewing operations with various stitch patterns, a memory device of a large capacity is required, involving high manufacturing and maintenance costs. Further, since the available stitch patterns are restricted to those stored in the memory device, it is impossible or at least difficult to perform the sewing operation with any given stitch patterns as desired by the user.

SUMMARY OF THE INVENTION

An object of the invention is to eliminate the disadvantages of the hitherto known control apparatus for the electrically driven sewing machine.

BRIEF DESCRIPTION OF THE DRAWINGS

FIG. 9A illustrates schematically an example of a stitch pattern.

FIG. 9B is a table listing coded data of the pattern shown in FIG. 9A.

FIG. 9C is a diagram illustrating a set pattern corresponding to the pattern show in FIG. 9A.

DETAILED DESCRIPTION OF THE PREFERRED EMBODIMENTS

Figure 1:
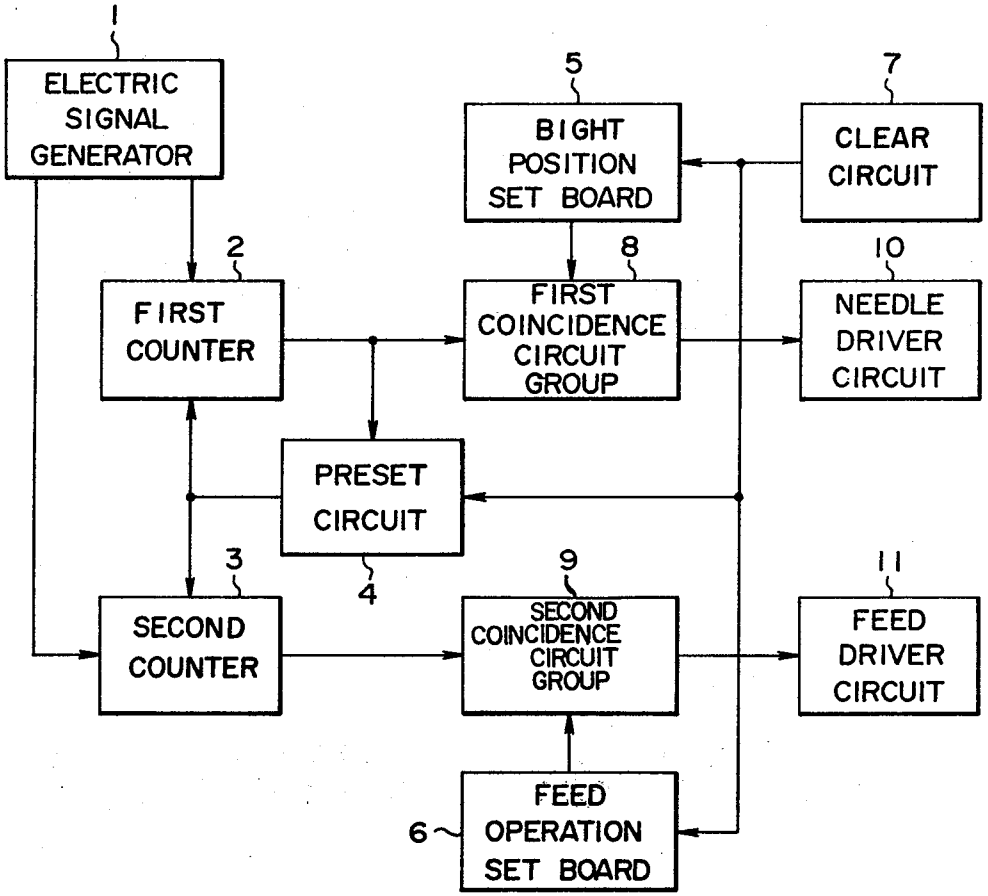
FIG. 1 is a block diagram of an examplary embodiment of the control apparatus for an electrically driven sewing machine according to the invention.

FIG. 1 is a block diagram showing a typical embodiment of a control apparatus for an electric-motor driven sewing machine provided with a device for allowing pattern stitches. The control apparatus comprises an electric signal generator circuit 1 which may be constituted by an electric signal generator circuit disclosed in U.S. Pat. application Ser. No. 825,473 filed on Aug. 8, 1977 under the title "MOTOR DRIVEN SEWING MACHINE" which has been assigned to the same assignee as the present application. The electric signal generator circuit 1 is adapted to generate two digital signals associated with two predetermined rotational angular positions of a main shaft (not shown) of the sewing machine, i.e., the first digital signal corresponding to the first angular position of the main-shaft in which a needle bar is positioned at a position between the upper dead point and cloth during its movement from the cloth toward the upper dead point and the second digital signal corresponding to the second angular position of the main-shaft in which the needle bar is positioned at a position between the upper dead point and the cloth during its movement from the upper dead point toward cloth. The first digital signal produced by the electric signal generator circuit 1 is counted by a first cascaded binary counter 2 which may have a 4-bit capacity, while the second digital signal is counted by a second cascaded binary counter 3 of 4-bit capacity in a similar manner. Each of the first and second counters is adapted to count the respective digital signals up to fifteen and to be reset to zero by the sixteenth digital signal, thereby to allow a pattern of sixteen stitches to be automatically repeated. The binary output signal from the counter 2 is supplied to a preset circuit 4 which serves to reset the counters 2 and 3 when the content in the counter 2 has attained a count value designated by the preset circuit. Thus, a sewing pattern consisting of a designated number of stitches or needle operations can be repeatedly produced. The binary output from the first counter 2 is supplied to a first group of coincidence circuits 8, while the binary output from the second counter 3 is supplied to a second group of coincidence circuits 9. A bight position coordinate for a desired sewing pattern of sixteen stitches at maximum can be set at a needle bar position set board 5. Cloth feed information corresponding to desired sewing patterns can be set at a cloth feed operation setting board 6. The bight position information set at the bight position set board 5 is stored in the first coincidence circuit group 8 and adapted to be sequentially addressed by the binary output from the first counter 2 to be read in correspondence with the content in the counter 2. The information thus read out is supplied to a needle bar driver circuit 10 to move sequentially the needle bar to predetermined positions in dependence upon the patterns as read out. The cloth feeding information set at the feed operation set board 6 is stored in the second coincidence circuit group 9 and sequentially addressed by the binary output from the second counter to be read out in accordance with the content in the second counter 3. The information thus read out is then supplied to a cloth feed driver circuit 11 thereby to effect sequentially the cloth feed operation with a predetermined width in dependence upon the pattern as read out. In this manner, the bight position information as well as the cloth feeding information which can be arbitrarily set are sequentially read out in dependence upon the contents in the associated counters to accomplish a complete stitch pattern when the content in the counters have attained the value set at the preset circuit 4 and all the stored information has been read out. Then, the counters will be automatically set in the reset condition ready for beginning to count again starting from "1" to perform the pattern sewing repeatedly. When it is desired to carry out the sewing in a different stitch pattern after the completion of the preceding pattern sewing, the bight position information set at the needle bar position set board 5 as well as the cloth feeding information set at the feed operation set board 6 are erased by a clear circuit 7. Then, the boards 5 and 6 are in the state ready for allowing new information of a different pattern to be stored.

Figure 2:
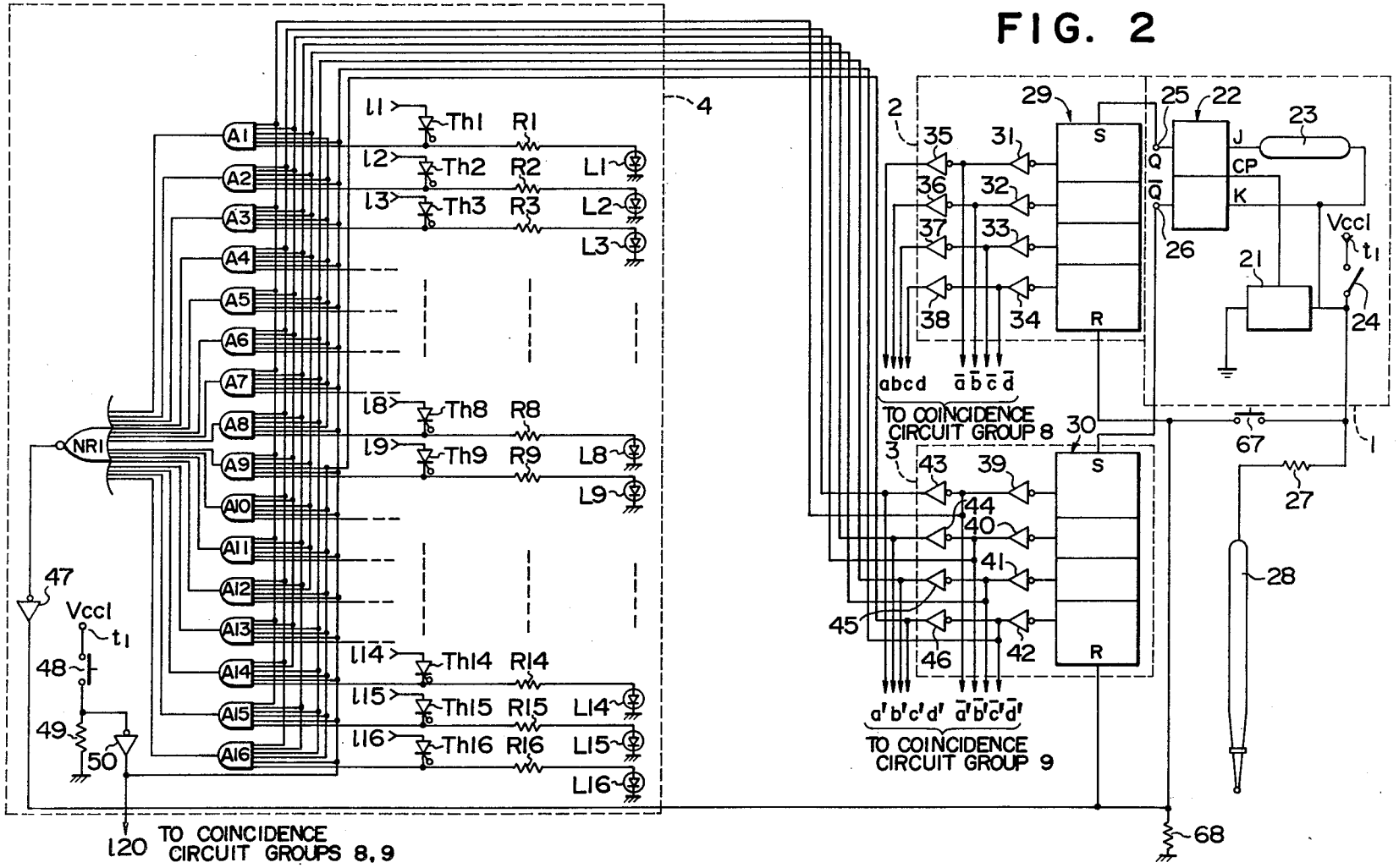
FIG. 2 is a circuit diagram showing details of an electric signal generator circuit, a first counter, a second counter and a preset counter shown in FIG. 1.

Next, typical embodiments of the individual blocks shown in FIG. 1 will be described in detail by referring to FIGS. 2 et seq. The electric signal generator circuit 1, the first counter 2, the second counter 3 and the preset circuit 4 are shown in detail in FIG. 2. The electric signal generator circuit 1 comprises a pulse generator circuit 21, a J-K flip-flop 22, a delay circuit 23 and a single-pole single-throw switch 24. The pulse generator circuit 21 is adapted to detect two predetermined angular positions of the main shaft interlocked with the needle bar and cloth feeding mechanism, that is, the first position of the needle bar between the cloth and the upper dead point during its movement to the upper dead point from the cloth and the second position of the needle bar between the upper dead point and the cloth during its movement toward cloth from the upper dead point, thereby to produce pulses in dependence upon the predetermined two angular positions. The output from the pulse generator circuit is connected to the CP input terminal of J-K flip-flop 22 which has a J-input terminal connected to a terminal $t_1$ of a D.C. power source (not shown) through the delay circuit 23 and the switch 24 and applied with a source voltage $V_{cc1}$ and a K-input terminal connected directly to the terminal $t_1$ of the power source. Further, J-K flip-flop 22 has a Q-output terminal connected to the first binary counter 29 of the 4-bit capacity, while $\overline{Q}$-output terminal of the flip-flop 22 is connected to the second binary counter 30 of the 4-bit capacity. The switch 24 is connected to the reset inputs of the first and the second counters 29 and 30 through a push button switch 67. Thus, when the J-K flip-flop 22 is applied with DC source voltage by closing the switch 24, the $\overline{Q}$-output of the flip-flop 22 will become at a high level, while Q-output will be at a low level. The $\overline{Q}$-output will be applied to the second counter 30 to cause the latter count "1". However, at this time, the push button 67 is pressed so that the first and the second counters 29 and 30 are reset with the contents of the first and the second counters remaining equal to "O's", respectively. Under such conditions, it is assumed that the needle bar will necessarily take the predetermined second position in the displacement toward cloth from the upper dead point. When an electric motor (not shown) for the sewing machine is energized, the main shaft is rotated to move downwardly the needle through cloth to the lower dead point and hence again toward the upper dead point. When the needle bar reaches the predetermined first position during this upward stroke, a first pulse is generated by the pulse generator circuit 21 and applied to the CP input terminal of J-K flip-flop 22, which will result in inversion of the Q and $\overline{Q}$-outputs, i.e., the Q-output becomes then at a high level, while $\overline{Q}$-output becomes at a low level. On the other hand, when the needle bar reaches the predetermined second position during the downward stroke toward the lower dead point, the Q-output will become high, while the $\overline{Q}$-output becomes low. Subsequently, at the predetermined first position during the upward stroke of the needle bar toward the upper dead point, the Q-output will again be high level with $\overline{Q}$-output being low. In this manner, in the stationary state of the needle bar after the closure of the switch, Q and $\overline{Q}$-outputs of the J-K flip-flop 22 are, respectively, at low and high levels. At that time, the first counter 29 has a binary output with bits a, b, c, d = "0,0,0,0", while the second counter has a binary output with bits a', b', c', d' = "0,0,0,0". During the succeeding down stroke of the needle bar from the upper dead point toward cloth as initiated by the rotation of the electric drive motor, the contents in both counters remain "0". When the needle bar has reached the predetermined first position during its upward stroke toward the upper dead point, the Q-output from the flip-flop 22 will become at a high level with the $\overline{Q}$-output being at a low level, resulting in the contents of the first and second counters a, b, c, d and a', b', c', d' being, respectively, "1,0,0,0" and "0,0,0,0". During the succeeding downward stroke of the needle bar from the upper dead point toward the cloth, the binary outputs from the second counter is incremented to "1,0,0,0" upon the needle reaching the predetermined second position. Thereafter, the first and second counters are each incremented by "1" for every reciprocation of the needle bar. In this connection, it is noted that the binary outputs from the second counter 30 are supplied to AND gates A1 to A16 for the present circuit 4 through NOT (negation) gates 39 to 46 and additionally coupled to the second coincidence circuit group 9 shown in FIG. 6. The binary outputs from the first counter 29 are coupled to the first coincidence circuit group shown in FIG. 5 through NOT gates 31 to 38.

The preset circuit 4 has a function to clear the first and second counters when the content in the second counter 30 has attained a desired value. Each of AND gates A1 to A16 has six inputs, four of which are connected to the binary output stages of the second counter, and serve to decode the binary output from the second counter into a corresponding decimal number of "1" to "16". In more particular, decimal "1" is decoded by the AND gate A1 and decimal "16" is decoded by the AND gate A16. Another input of each AND gate is connected to an electrode of a switch element, e.g. a cathode electrode of an associated thyristor TH1 to Th16. The other remaining inputs of the AND gates are grounded through a NOT gate 50 and a resistor and at the same time connected to the DC source terminal $t_1$ through the push buttom switch 48. Thus, the terminal $t_1$ is supplied with low and high level voltage in dependence upon "ON" and "OFF" states of the push button switch 48, respectively. The thyristors Th1 to Th16 have respective anode electrodes connected to a DC power source terminal $t_2$ through associated DC supply lines l1 to l16 so as to be applied with a source voltage $V_{cc2}$. The cathode electrodes of the thyristors Th1 and Th16 are grounded through respective series connections of resistors R1 to R16 and light emission diodes L1 to L16. Outputs from the AND gates A1 to A16 are input to a NOR gate NR1 which has an output connected to the reset input of the first counter on one hand and to the reset input of the second counter 30 on the other hand through a NOT gate 47. Assuming that a pattern sewing consisting of eight stitches is to be repeatedly carried out, the pointed end of a probe 28 connected to the DC source terminal $t_1$ through the protection resistor 27 and switch 24 is contacted to the gate electrode of the thyristor Th9, thereby to apply the DC source voltage $V_{cc1}$ to the gate of the thyristor Th9 to make it conductive. Then, one input to the AND gate A9 becomes at a high level or logic "1". Simultaneously, the light emission diode L9 which is connected to the cathode electrode of the thyristor Th9 through the resistor R9 is energized to give a display that the pattern sewing operation consisting of eight stitches is executed. The inputs of the other AND gates connected to the cathode electrodes of the other thyristors are at a low level or logic "0", the outputs of these AND gates will be logic "0" regardless of input conditions of the counters. At the initiation of the needle movement, the first counters 29 and 30 begin to count and outputs therefrom representative of the contents of the counters are applied to the associated AND gates, the outputs of which will, however, remain logic "0's" until the contents of the counters have attained decimal "8". When the needle reaches the predetermined second position during its downward stroke after the completed sewing operation of eight stitches, the contents in the second counter 30 becomes equal to "8", resulting in the four inputs $\bar{a}$, $\bar{b}$, $\bar{c}$, $\bar{d}$ to the AND gate A9 being equal to "1, 1, 1, 1". Thus, the AND gate A9 now produces logic "1" output to the NOR gate NR1, the output of which is then switched to a low level or logic "0" from the high level or logic "1" state. The output from the NOR gate NR1 is inverted through the NOT gate 47 to the high level and applied to the reset input terminals R of the first and second counters 29 and 30, thereby to reset the contents thereof to zero. Accordingly, during the time span when the needle passes through the cloth to the lower dead point and again moves upwardly toward the cloth, the contents of the first and second counters remain "0's". When the needle continues to move upwardly to the upper dead point and reaches the predetermined first position on the way, the first counter 29 is gain incremented by "1". After succeeding alternative counting operations of the first and second counters until the contents of the latter has become equal to "8", both counters will be again reset to zero. In this manner, the eight stitch pattern sewing operation is repeated.

Figure 3:
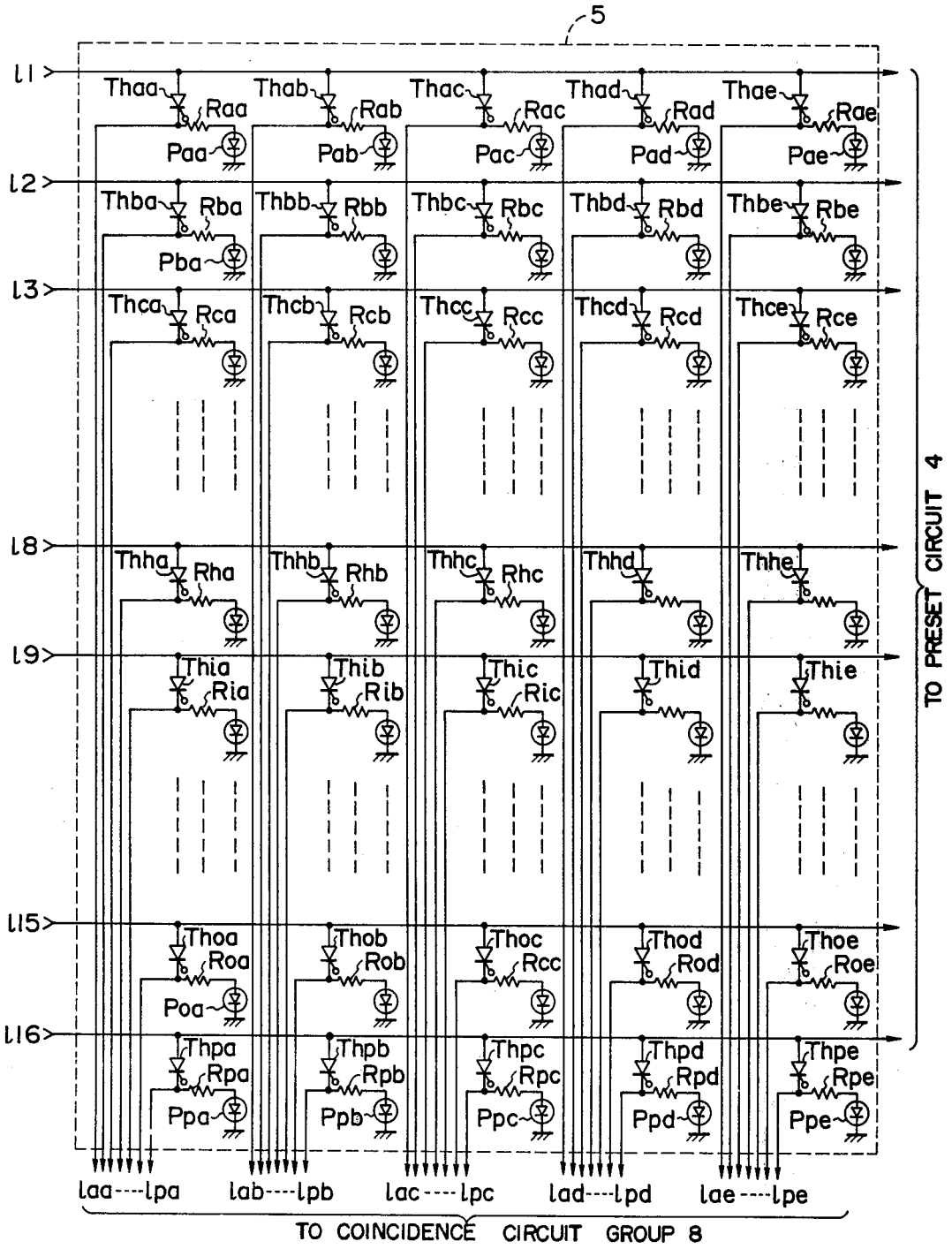
FIG. 3 is a circuit diagram of a needle position or bight position set board.
Figure 4:
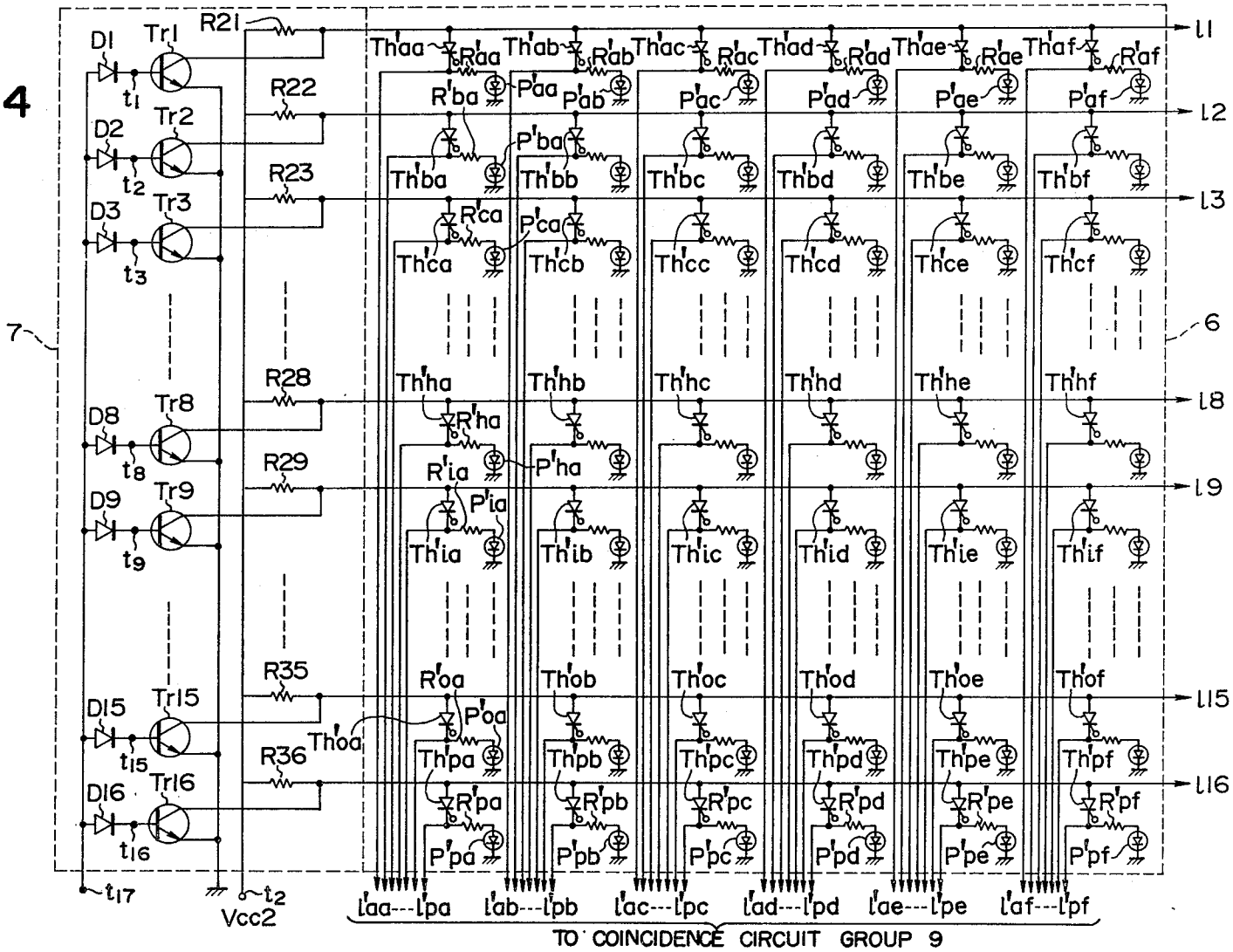
FIG. 4 is a circuit diagram of a cloth feed operation set board and a clear circuit.

FIG. 3 shows an embodiment of the bight position setting board 5 shown in FIG. 1. FIG. 4 shows details of the cloth feed operation setting board 6 and the clear circuit 7. The bight position setting board 5 comprises a plurality of units each including a switching element such as a thyristor and arranged in a matrix array. In the illustrated embodiment, each of the cross-point units of the matrix array is composed of a thyristor, a light emission diode and a resistor. The row of the matrix array corresponds to the stitch number of the needle and 16 rows a to p are provided to allow 16 stitches to be executed at maximum for illustrative purpose. On the other hand, columns of the matrix represent positional coordinates of the needle. In the case of the illustrated embodiment, the number of columns is selected at 5 (columns a to e) so that nine kinds of positional coordinates can be designated. The anodes of thyristors of every row are connected to a common DC current supply line. For example, the anodes of the thyristors Th aa to Th ae (the preceding suffix identifies the row, while the following identifies the column) belonging to the row a are connected to a common DC supply line l1. The cathodes of the thyristors of every column are connected to associated AND gates of the first coincidence circuit group 8. For example, the cathode electrodes of the thyristors Th aa to Th pa of the column a are connected to one input of the associated AND gates A aa to A pa of the first coincidence circuit cl through lines l aa to l ap (the attached suffixes correspond to those of the symbols labelled to the thyristor and the same apply to the suffixes attached to the AND gates of the coincidence circuits). Further, the cathode electrodes of all the thyristors Th aa to Th pe are grounded through respective series connections of resistors R aa to R pe and light emission diodes or LED's P aa to P pe.

Referring to FIG. 4, the cloth feeding operation setting board 6 comprises a plurality of units each composed of a thyristor, a resistor and a LED and arranged in a matrix array in a similar manner as the bight position setting board 5. For the illustrative purpose, the number of rows in the matrix array is selected equal to 16 (rows a to p) in correspondence with the stitch numbers of the needles of a statch pattern. The columns are provided in number of 6 (columns a to f) so that eleven kinds of cloth feeds can be selectively performed. The column a corresponds to a large forwarding feed, b corresponds to a first intermediate forwarding feed, c corresponds to a small forwarding feed, d corresponds to a stop, e corresponds to a small returning feed and f corresponds to a large returning feed. Further, a combination of the columns a and b designates a second intermediate forwarding feed between the large and the first intermediate forwarding feed. Combination of the column b and c designate a third intermediate forwarding feed between the first intermediate and the small forwarding feeds. Combination of the columns c and d designates a half forwarding feed of the small forwarding feed. Combination of the columns d and e designates a half returning feed of the small returning feed. Further, combination of the columns e and f designates an intermediate returning feed between the small and large returning feeds. Anodes of the thyristors of each row are connected to a common DC supply line. For example, the anodes of thyristors Th'aa to Th'af belonging to the row a are connected to a line l1. The cathode electrodes of the thyristors of each column are connected to associated AND gates of the second coincidence circuits. For example, the cathodes of thyristors Th'aa to Th'pa of the column a are connected to one inputs of AND gates A'aa to A'pa of the second coincidence circuit c6 shown in FIG. 6 through lines l'a to l'p. Suffixes attached to the symbols Th', A' and e' represent correspondences or associations among these elements.

DC supply lines l1 to l16 are connected to the common DC power source terminal $t_2$ through associated resistors R21 to R36, thereby to apply DC voltage $V_{cc2}$ to the anode electrodes of thyristors. Connected to the resistors R21 to R36 are switching elements such as PNP-type transistors Tr1 to Tr16 and diodes D1 to D8 which are respectively connected in series so as to form the clear circuit 7. When the switching transistor is turned on, the associated resistor is short-circuited to set zero the anode potential of the associated thyristor. For example, the transistor Tr1 has collector connected to the anode electrode of thyristor Th'aa of the column a, an emitter electrode grounded and a base electrode connected to the cathode electrode of a block diode D1 through the terminal $t_1$, the anode electrode of which is connected to a common terminal $t_{17}$. With such an arrangement, when the probe 28 is contacted to a terminal $t_9$, the source voltage $V_{cc}$ is applied only to the base electrode of the transistor Tr9 through the block diode D9, thereby to turn on only the transistor Tr9 with the resistor R29 being short-circuited. Consequently, DC voltage on the line l9 becomes zero, whereby anode potentials of the thyristors Th'ia to Th'if of the cloth feeding operation setting board 6, the thyristors Th ia to Th if of the bight position setting board 5 and the thyristor Th9 of the preset circuit 4 are caused to become zero. In this manner, by contacting the probe 28 to an arbitrary terminal, thyristors belonging to the associated column can be cut off. Contacting to a terminal $t_{17}$ causes the thyristors of all the columns to be turned off.

Figure 5:
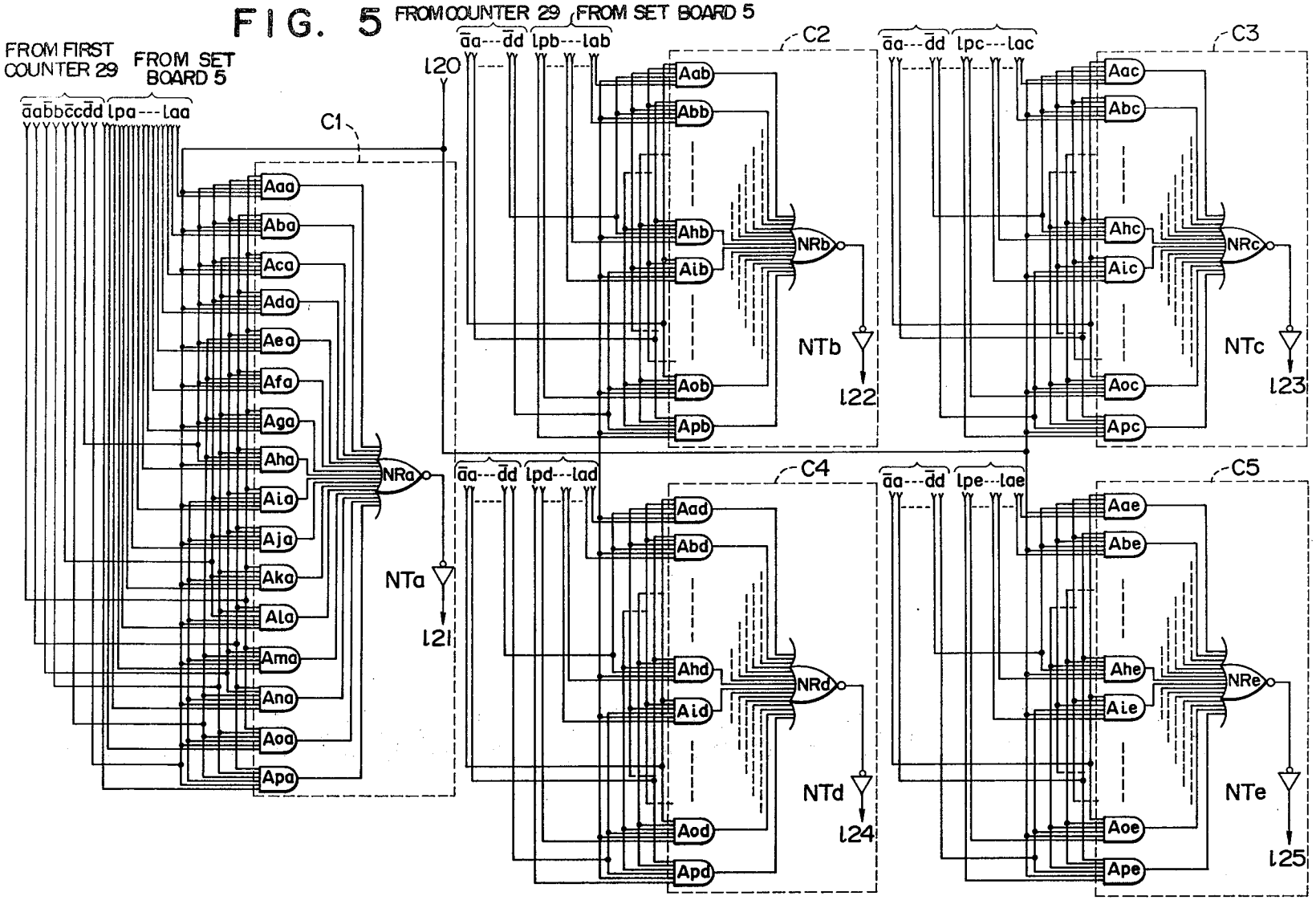
FIG. 5 is a circuit diagram of a first coincidence circuit group.

FIG. 5 shows in detail the first coincidence circuit group 8 shown in FIG. 1. As can be seen from the figure, the first coincidence circuit group includes five coincidence circuits C1 to C5, each of which in turn is composed of a NOR gate NR, a NOT or NEGATION circuit NT and sixteen AND gates Aa to Ap in association with the five bight position coordinates of the bight position setting board 5. Each of the sixteen AND gates has six inputs, the four of which are connected to the first counter 29 so as to serve for decoding the binary outputs from the counter 29 into a corresponding decimal number of "1" to "16". Another input of each AND gate is connected to cathode electrode of the associated thyristor of the bight position set board, while the remaining inputs of the AND gate are connected to the NOT circuit 50 through a line l20, the outputs of these AND gates are input together to associated NOR gates NRa to NRe. The outputs from the latter are then coupled to the needle bar driver circuit 10 shown in FIG. 7. by way of the associated NOT gates NTa to NTe and lines l21 and l25. For example, one input of the AND gate Aaa of the coincidence circuit C1 is connected to the cathode electrode of thyristor Th aa disposed at the intersection between the row a and the column a of the bight position set board. Four inputs of the AND gate A aa are connected to the binary output terminals $\bar{a}$, $\bar{b}$, $\bar{c}$, $\bar{d}$ of the first counter in order to decode the binary output into a decimal number "0" or "16", while the remaining input of the AND gate Aaa is connected to the NOT circuit 50 through the line l20. Another AND gate Aba has one input connected to the cathode electrode of the thyristor Thba with four inputs thereof connected to the binary ouput terminals $\bar{a}$, $\bar{b}$, $\bar{c}$, $\bar{d}$ of the first counter to decode the binary output thereof into the decimal number "1". The outputs from the AND gates Aaa to Apa are input to the NOR gate NRa (the suffix denotes a corresponding row of the bight position set board 5), the output of which in turn is coupled to the base electrode of an associated transistor Tra of the bight position driver circuit 10 through a line l21 and the NOT circuit NTa.

Figure 6:
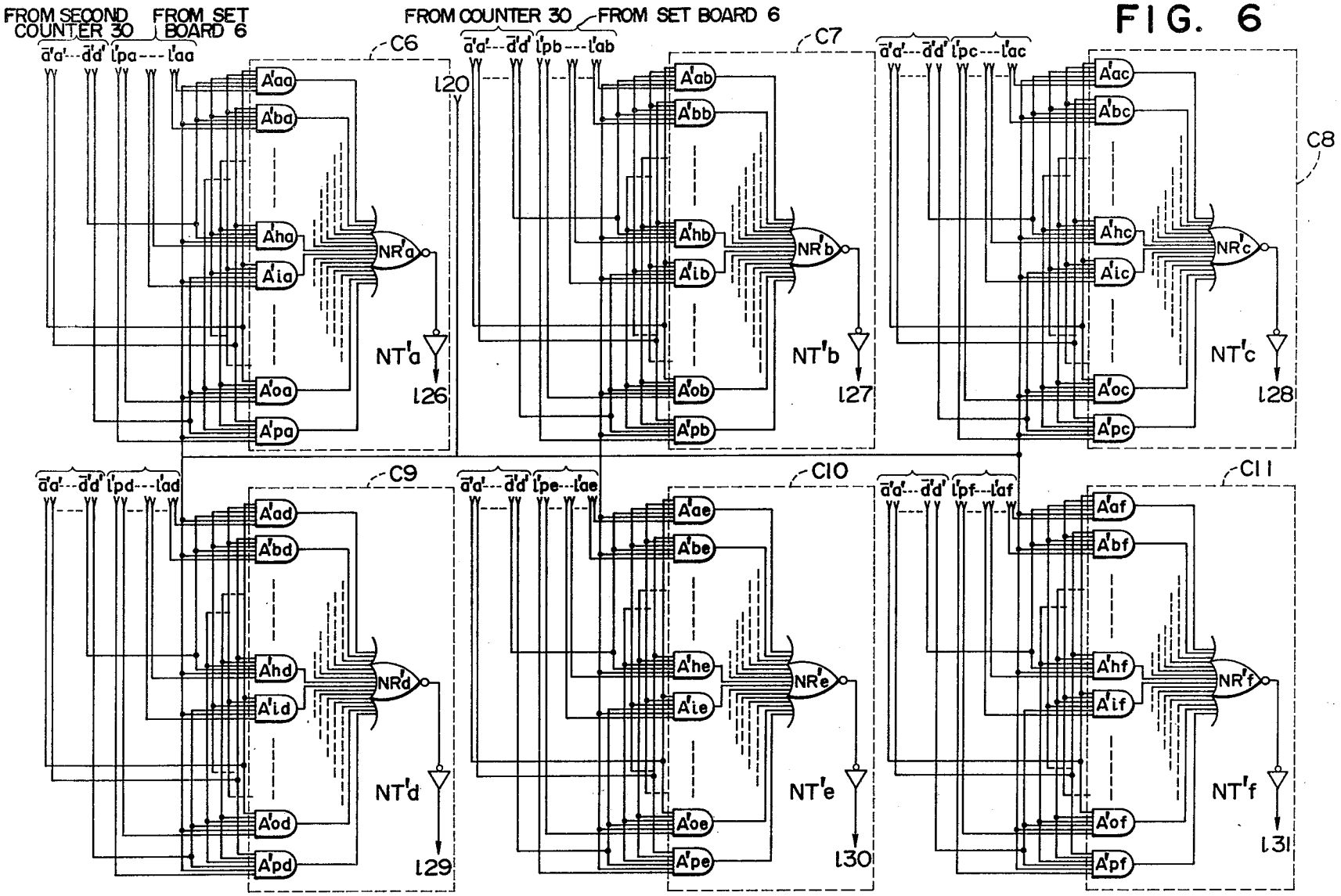
FIG. 6 is a circuit diagram of a second coincidence circuit group.

The second coincidence circuit group 9 shown in detail in FIG. 6 comprises six coincidence circuits C6 to C11 associated with six feeding information. Each of the coincidence circuits is composed of a NOR gate (NR'a to NR'f, wherein suffixes represent corresponding matrix columns in the feed operation set board 6), a NOT circuit (T'a to T'f) and sixteen AND gates (A'aa to A'pa, A'ab to A'pb, A'ac to A'pc, A'ad to A'pd, A'ae to A'pe and A'af to A'pf wherein the suffixes represent the corresponding rows and columns of the feed operation set board 6). Each of the sixteen AND gates constituting each of the coincidence circuits has six inputs, the four of which are connected to the second counter 3 to decode the binary output thereof into a corresponding decimal number 1 to 16. Another input of the AND gate is connected to the cathode electrode of the associated thyristor of the feed operation set board, while the remaining input is connected to the NOT gate 50 through the line l20. The outputs from these AND gates are input together to a NOR gate, the output of which in turn is coupled to the feed driver circuit 11 through the lines l26 to l31.

Figure 7:
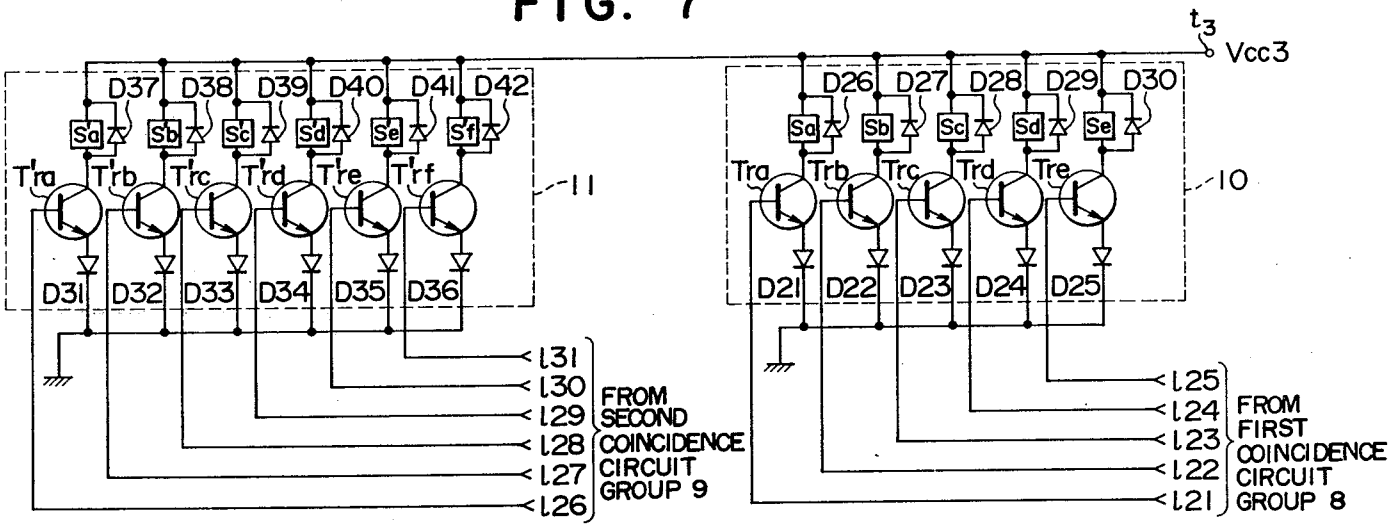
FIG. 7 is a circuit diagram of a needle driver circuit and a cloth feed driver circuit.

Details of the needle driver circuit and the feed driver circuit are shown in FIG. 7. The needle bar driver circuit 10 serves to set the needle bar at the positional coordinate commanded by the bight position set board 5. The outputs from the coincidence circuits C1 to C5 are connected to gate electrodes of switching elements e.g. base electrodes of NPN-transistors Tra to Tre through the lines l21 to l25, respectively. The transistors have respective collector electrodes connected to a DC power source $V_{cc3}$ of about 12 V to 14 V through solenoid coils Sa to Se, respectively. The emitters of these transistors are grounded through diodes D21 to D25, respectively. Diodes D26 to D30 are connected in parallel to the solenoid coils Sa to Se to discharge energy stored in the solenoid coils Sa to Se after the transistors have been turned off. The suffixes a to e attached to the solenoids Sa to Se and the transistors Tra to Tre denote that these elements are associated with the NOR gates NRa to NRe of the coincidence circuits C1 to C5. The solenoids Sa and Se are connected in a manner shown in FIG. 8.

Figure 8:
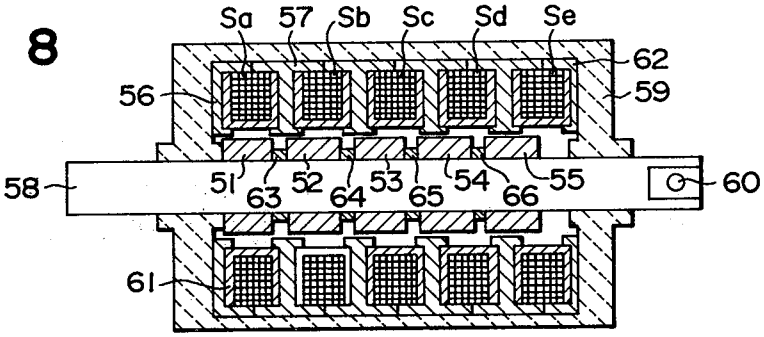
FIG. 8 is a sectional view of a needle bar driving apparatus.

FIG. 8 shows an electro-magnetic driving device which comprises a cylindrical body 59 having a yoke member 56 forming a magnetic path disposed therein. A bobbin 61 around which the solenoid coil Sa is wound is positioned fittingly in the yoke 56. Another magnetic path yoke member 57 having a recess for fittingly receiving another bobbin for the solenoid coil Sb is disposed adjacent to the bobbin 61. In a similar manner, bobbins wound with the solenoid coils Sc to Se are disposed alternatively with associated yoke members as delimited by a yoke 62. In this manner the solenoid coils Sa to Se are disposed within the cylindrical housing 59 with the same distance therebetween. A shaft 58 of a non-magnetic material extends axially through the cylindrical housing 59 and is provided with annular mangetic members 51 to 55 with a constant space therebetween. Magnetic path isolating spacers 63 to 66 are disposed between the annular magnetic members. The shaft 58 is formed with a hole 60 through which the needle bar may extend. The shaft 58 and the annular magnetic members 51 to 55 constitute a driven unit which is axially slidably supported with the shaft extending through apertures formed in the end walls of the cylindrical housing 59. Distance between the centers of the yoke members is selected greater than the one defined between the adjacent annular magnetic members 51 to 55. Due to such arrangement, the dimension spanning the opposite end faces of the annular magnetic members 51 and 55 disposed at both extremities is smaller than the distance between delimiting yoke members 56 and 62, whereby a space is available between the magnetic member 55 and the delimiting yoke member 62. This space defines the range in which the driven unit can be displaced. It should be noted that the dimension of this space is selected smaller than the distance between the centers of two adjacent hoke members.

With the driving apparatus of the structure described above, when one transistor, e.g. the transistor Trb, is turned on to cause excitation current to flow through the solenoid coil Sb, magnetic flux produced in the yoke enclosing the coil Sb passes through the magnetic member 52 thereby to complete a closed magnetic path therein. Thus, the magnetic member 52 is magnetically displaced to the right as viewed in FIG. 8 to be positioned at the middle point between the yoke members surrounding the coil Sb. The movement of the magnetic member 52 is of course accompanied by the corresponding movement of the shaft 58 to bring the needle inserted through the hole 60 to a position b. In this manner, by selectively exciting one of the solenoid coils Sa to Se, the needle bar can be located at a corresponding position among plural preset positions (positions a to e and intermediate positions therebetween).

The feed driver circuit 11 shown in FIG. 7 functions to feed cloth for a distance commanded from the feed operation set board 6. The outputs from the coincidence circuits C6 to C11 are coupled to switching elements such as NPN transistors T'ra to T'rf at the base electrodes thereof. The transistors T'ra to T'rf have collector electrodes connected to the DC power source terminal $t_3$ through the solenoid coils S'a to S'f, respectively, and adapted to be applied with a DC voltage $V_{cc3}$. Diodes D37 to D42 are connected in parallel with the solenoid coils S'a to S'f, respectively, for discharging energy stored in these solenoid coils. The transistors T'ra to T'rf have emitter electrodes grounded through the diodes D1 to D36, respectively. Suffixes a to f attached to the reference symbols of the solenoid coils and the transistors represent that these elements are associated with the NOR gates NR'a to NR'f, respectively, of the coincidence circuits C6 to C11. The mechanism for performing the cloth feeding under the control of the solenoid coils S'a to S'f can be implemented in a similar structure as the needle driving apparatus shown in FIG. 8 in such a manner that energization of the solenoid S'a brings about a large forwarding feed of cloth, energization of solenoid S'b brings about an intermediate forwarding feed, energized solenoid S'c causes a short forwarding feed, energization of S'd stops the feeding, energization of the solenoid S'e causes a small returning feed and the energized solenoid S'f brings about a large returning feed.

Next, description will be made or the operations of the control apparatus according to the invention when the sewing operation of a desired stitch pattern is to be performed. It is assumed that a sewing pattern consisting of 16 stitches as shown in FIG. 9A is to be produced. At the stitch number zero (0), the needle is positioned at the bight position a at which the feed to be effected is zero. Under the conditions, the probe 28 is contacted to the gate electrode of the thyristor Th aa positioned at the intersection between the row a and the column a of the bight position set board 5, thereby to turn on the thyristor Th aa on the one hand, and on the other hand the probe is also contacted to the gate electrode of the thyristor Th'aa located at the cross-point between the row a and the column d of the feed operation set board 6, thereby to make the thyristor Th'aa to be conductive. In this connection, it should be appreciated that the column d represents zero feed. Then, LED's Paa and P'aa are energized to display that the thyristors Th aa and Th'ad are conductive. Output "1" from the thyristor Th aa is applied to the AND gate Aaa of the first coincidence circuit C1 through the line laa, while the output "1" from the thyristor Th'ad is input to the AND gate A'ad of the second coincidence circuit C1 through the line laa. At the stitch number 2, the needle is positioned at a at which the small forward feed is to be effected. Thus, the thyristor Th ba located at the crosspoint between the row b and the column a of the bight position set board is turned on by contacting the probe 28 to the gate electrode thereof and subsequently the thyristor Th'bc positioned at the cross-point between the row b and the column c in the matrix array of the cloth feed operation set board is turned on, which also results in the light emission from the LED's Pba and P'bc. The output "1" from the thyristor Thba is supplied to the AND gate Aba of the first coincidence circuit C1 through the line lba, while the output "1" from the thyristor Th'b is applied to the AND gate A'bc of the second coincidence circuit C8 through the line l'bc. In a similar manner, the coordinates of the subsequent bight positions starting from the one corresponding to the stitch number 3 and the corresponding cloth feeding quantities are set at the bight position set board 5 and the feed operation set board 6 on the basis of the predetermined coordinate sequence such as shown in FIG. 9B. When a pattern is established in this way, the thyristors of the bight position set board 5 and the feed operation set board 6 are turned on in patterns and sequences shown in FIG. 9c, in which blank circles represents the thyristors or LED's which remain in the off state and solid circles indicate those which are turned on.

When the pattern has been determined as described above, the switch 24 is closed to apply DC source voltage $V_{cc1}$ to the electric signal generator circuit 1 and the probe 28. At the same time, the push button switch 49 is opened to apply the DC voltage $V_{cc1}$ to the preset circuit 4, the first coincidence circuit group 8 and the second coincidence circuit group 9. Then, the Q-output from the J-K flip-flop 22 of the signal generator circuit 1 will become at a low level with the $\bar{Q}$-output being at a high level. However, since the contents in the first and the second counters 29 and 30 are equal to "0" at this time point, the first coincidence circuit group 8 is supplied with output signals "0,0,0,0" from the binary output terminals a, b, c, d of the first counter 29, and the second coincidence circuit group 9 is also supplied with logic "0,0,0,0" from the binary outputs a', b', c', d' of the second counter 30.

In the first coincidence circuit group 8, the AND gates responding to the contents "0's" in the first counter 29 are Aaa, Aab, Aac, Aad and Aae which thus have the four input $\bar{a}, \bar{b}, \bar{c}, \bar{d}$ of a high level from the first counter. The inputs to the other AND gates from the first counter will contain more than one "0" or low level. In the meantime, since the conducting thyristor among those belonging to the row a in the matrix of the bight position set board 5 is the one that lies in the column a, namely, the thyristor Th aa only, the logic "1" or high level signal is applied to one input of the AND gate Aaa through the line laa. Thus, only the AND gate Aaa produces logic "1" to be applied to the NOR gate NRa, the output of which is thus changed over from logic "1" to "0". The output "0" is then applied to the negation or NOT circuit NTa which in turn produces logic "1" to be applied to the transistor Tra of the needle driver circuit 10 through the line l21, resulting in the energization of the solenoid coil Sa. The needle bar is then set to the position a. Since the outputs from the other NOR gates NRb, NRc, NRd and NRe are logic "1's" with the output from the associated negation circuits NTb to NTe being "0's", the associated solenoids Sb to Se will not be energized. Also in the case of the second coincidence circuit group 9, the four inputs $\bar{a}$, $\bar{b}$, $\bar{c}$, $\bar{d}$ to the AND gates A'aa, A'ab, A'ac, A'ad, A'ae and A'af responding to the content "0" in the second counter 30 will be logic "1's". Further, only the thyristor Th'ad among those belonging to the row a is conductive. Under these conditions, logic "1" output is supplied to the AND gate A'ad which then produces the high level or logic "1" output. This results in the low level or "0" output from the NOR gate R'd which, after having been inverted by the negation or NOT circuit to the logic "1", is applied to the transistor T'rd thereby to energize the solenoid S'd. This means zero feed and no cloth feeding will take place.

When the drive motor for the sewing machine is operated, the needle bar is moved downwardly from the upper dead point toward the cloth and subsequently moved upwardly to the upper dead point, as the main shaft is rotated by the motor. When the needle bar attains a predetermined position during this upward stroke, the Q-output of J-K flip-flop 25 of the electric signal generator circuit 1 will go high with $\bar{Q}$-output going low. Then, the first counter is incremented by "1" to produce the outputs, "1,0,0,0" at the terminals a, b, c, d. However, the contents in the second counter remains "0's". Under these conditions, since the AND gate A'aa of the second coincidence circuit group continues to output logic "1" thereby to energize continuously the solenoid S'd of the feed driver circuit 11, no cloth feeding is carried out. On the other hand, when the content in the first counter 29 is incremented to "1", the four inputs $\bar{a}$, $\bar{b}$, $\bar{c}$, $\bar{d}$ to the associated AND gates Aba to Abe of the first coincidence circuit group 8 will become logic "1's". However, because the inputs to the other AND gates contains at least one logic "0", the output of the AND gate Aaa goes low. At this time point, only the thyristor Th ba among those belonging to the row b of the bight position set board 5 is in the conductive state. Accordingly, a logic "1" signal is applied to one input of the AND gate Aba through the line lba, which gate now produces logic "A" and the resulting output "0" from the NOR gate NRa is inverted by the NOT or negation circuit NTa to be applied to the solenoid Sa of the needle driver circuit 10. The needle bar is thus set again to the position a.

When the needle bar reaches the predetermined position during the succeeding downward stroke from the upper dead point as the main shaft is further rotated, the outputs from the J-K flip-flop 25 are inverted to produce Q-output of low level and Q-output of high level. The content of the second counter 30 is incremented to "1", while the first counter 29 remains in the previous state of count "1". Thus, no change will occur in the state of the first coincidence circuit group 8 with the needle bar being held at the position a.

To the contrary, in the second coincidence circuit group 9, the content "1" of the second counter 30 will cause the four inputs $\bar{a}'$, $\bar{b}'$, $\bar{c}'$, $\bar{d}'$ to the associated AND gates A'ba, A'bb, A'bc, A'bd, A'be and A'bf to go high or logic "1". Since the inputs to the other AND gates contain at least one logic "0" level, the output of the AND gate A'aa will go low. At this time point, the conductive thyristor among those Th'ba to Th'bf belonging to the row b of the feed operation set board 6 is only Th'bc at the column c. Thus, logic "1" is applied to one input of the AND gate A'bc through the line l'bc. In other words, the AND gate A'bc now produces logic "1" in place of the AND gate A'ad, whereby the NOR gate NR'c produce logic "0" which, after having been inverted by the NOT circuit NT'c, is applied to the solenoid S'c of the feed driver circuit 11. The small forwarding feed is thus effected.

As the main shaft is further rotated and thence the needle is moved again upwardly toward the upper dead point after having pieced through the cloth workpiece, the outputs of the J-K flip-flop 25 will be again inverted to produce Q-output of high level and Q-output of low level. The content in the first counter 29 is then incremented to "2" to produce binary outputs "0,1,0,0" at the bight positions a, b, c, d. However, no change will occur in the count state "1" of the second counter. Since the thyristor Thca at the row c of the bight position set board 5 is conductive at this time point, the AND gate Aca of the first coincidence circuit group 8 will produce the output logic "1" thereby to set the needle at the position a.

In this manner, when the needle bar attains the predetermined position during the upward stroke, the needle position information set at the bight position set board 5 is read out in dependence upon the contents in the first counter 29, thereby to set the needle bar at the corresponding position. On the other hand, when the needle bar attains the predetermined position during the downward stroke to the lower dead point, the cloth feed information set at the feed operation set board is read out independence upon the contents in the second counter 30, thereby to effect the preset cloth feeding. In this way, a pattern stitch is produced in the manner shown in FIG. 9A. When the sixteenth stitch has been accomplished and the needle bar attains the predetermined position during the upstroke toward the upper dead point, the contents in the first counter 29 will become "16" to produce the binary output "0,0,0,0" at the bight positions a, b, c, d, as a result of which the needle bar is set to the initial position a. When the needle bar attains the predetermined position on the way toward the lower dead point, the contents of the second counter 30 becomes equal to "16" and is reset to zero, thereby to initiate again the first cloth feed. In this manner, the same stitch pattern can be repeatedly produced.

If it is desired to repeat a sewing pattern of eight stitches, the thyristor Th9 of the preset circuit 4 is turned on as is shown in FIG. 9c. After a cycle of eight stitches has been completed, the first and second counters will be reset and the control circuit is in the state to repeat the same stitch pattern sewing.

In the foregoing description, it has been assumed that the set boards 5 and 6 are composed of thyristor matrixes. However, the invention is never restricted to such an embodiment but can be equally implemented by using flip-flop or ROM of X-bit capacity or the like.

The invention has thus provided a control apparatus for a sewing machine which allows desired stitch patterns to be easily set with extremely simplified configurations.

We claim:

1. A control apparatus for an electrically driven sewing machine with a stitch pattern producing apparatus, comprising:

electric signal generator means for generating an electric signal related to at least one predetermined angular position of a main shaft of the sewing machine;

probe means having a bias signal output;

set board means capable of setting therein a desired stitch pattern using said probe means, said set board means comprising;

a first switching matrix comprising a first coordinate composed of a plurality of coordinate points at intersections between a first predetermined number of rows and a second predetermined number of columns, and switching elements each having a control electrode and operable between first and second states, each of said switching elements being provided at each of said coordinate points, whereby said information of needle position of a desired stitch pattern is set in said coordinate;

a second switching matrix comprising a second coordinate composed of a plurality of coordinate points at intersections between said first predetermined number of rows and a third predetermined number of columns, and switching elements each having a control electrode and disposed at each of said coordinate points, whereby information of cloth feed operation of the desired stitch pattern is set at said second coordinate;

reset circuit means for resetting said switching elements from said second state to said first state;

each of said switching elements being adapted to be energized by applying said bias signal to said control electrode by contacting thereto said probe, thereby to be switched to said second state from said first state, wherein the coordinates of said energized switching elements of said first switching matrix represent said needle position information, while the coordinates of said energized switching elements of said second switching matrix represent said feed operation information;

pattern detecting means for reading out cloth feed information of the stitch pattern and information of needle position along the direction perpendicular to the cloth feed direction set in said set board means in response to said electrical signal;

said pattern detecting means being adapted to respond to said electrical signal for selecting one row from said predetermined number of rows of said first switching matrix and reading out the column coordinates of said switching elements operated in said second state and belonging to said selected row, thereby to output said column coordinates as said read-out needle position information;

said pattern detecting means being further adapted to respond to said electric signal for selecting one row from said predetermined number of rows of said second switching matrix and reading out the column coordinates of said switching elements operated in said second state and belonging to said selected row, thereby to output said column coordinate as said read-out feed operation information;

needle bar driving means for setting the needle bar at a predetermined position in dependence upon said information of needle position as read out; and cloth feeding means for effecting predetermined cloth feeds in dependence upon said feed information as read out, whereby sewing operation is carried out in the same stitch pattern as the one set at said set board means.

2. A control apparatus for an electrically driven sewing machine as set forth in claim 1, wherein said pattern detecting means comprises a counter for counting the number of said electric signals, a first circuit for continuously selecting one row among said predetermined number of rows of said first switching matrix and reading out the column coordinates of said switching elements operated in said second state and belonging to said selected row in dependence upon count contents in said counter, thereby to output said column coordinates as said information of needle position, and a second circuit for continuously selecting one row among said predetermined number of rows of said second switching matrix and reading out the column coordinates of said switching elements operated in said second state and belonging to said selected row in dependence upon count contents in said counter, thereby to output said column coordinates as said read-out feed operation information.

3. A control apparatus for an electrically driven sewing machine as set forth in claim 1, wherein each of said switching elements comprises a thyristor.

4. A control apparatus for an electrically driven sewing machine as set forth in claim 1, wherein each of said switching elements comprises a flip-flop.

5. A control apparatus for an electrically driven sewing machine as set forth in claim 1, wherein each of said switching elements comprises a ROM.

* * * * *